United States Patent [19]

Cutre et al.

[11] Patent Number: 4,725,045

[45] Date of Patent: Feb. 16, 1988

[54] SLAG-RETAINING PLUG FOR METAL POURING OPERATIONS

[76] Inventors: James R. Cutre, 242 Belden Pl., Munster, Ind. 46321; Donald K. Herald, 8043 North Drive, Highland, Ind. 46322; Donald L. Herald, 3322 Ann St., Lansing, Ill. 60438; John W. Schwer, 1349 Azalea, Munster, Ind. 46321

[21] Appl. No.: 869,010

[22] Filed: May 30, 1986

[51] Int. Cl.[4] ..... B22D 41/10

[52] U.S. Cl. ..... 266/230; 266/272; 222/597

[58] Field of Search ..... 266/45, 227, 230, 272; 222/590, 591, 597, 598, 602

[56] References Cited

U.S. PATENT DOCUMENTS

| | | | |
|---|---|---|---|
| 4,462,574 | 7/1984 | Keenan et al. | 266/45 |
| 4,494,734 | 1/1985 | Labate et al. | 266/272 |
| 4,526,349 | 7/1985 | Schwer | 266/272 |
| 4,601,415 | 7/1986 | Koffron | 266/272 |

FOREIGN PATENT DOCUMENTS

| | | | |
|---|---|---|---|
| 0128576 | 12/1984 | European Pat. Off. | 266/227 |
| 0029564 | 12/1969 | Japan | 266/227 |
| 0022602 | 6/1977 | Japan | 266/227 |

*Primary Examiner*—L. Dewayne Rutledge
*Assistant Examiner*—S. Kastler
*Attorney, Agent, or Firm*—Pearne, Gordon, McCoy & Granger

[57] ABSTRACT

A refractory plug for blocking the tap hole of a steel making vessel or transfer ladle containing molten steel covered by a layer of slag and for minimizing turbulence caused by vortexing. The plug comprises a body having an inverted cone-shaped bottom and having an integral top portion projecting axially from a top base surface of the cone-shaped bottom portion. The plug is added to the melt just prior to or during the tapping operation to minimize vortexing and to plug the tap hole prior to egress of the slag.

7 Claims, 2 Drawing Figures

SLAG-RETAINING PLUG FOR METAL POURING OPERATIONS

BACKGROUND OF THE INVENTION

This invention relates to a slag-retaining plug for use in steel making and, more particularly, to a floatable plug which floats in a predetermined position in the slag layer and partially in the underlying molten steel in a predetermined position to minimize vortexing upon tapping of the molten steel and to automatically close the tap hole prior to any draining of slag from the tap hole.

In the production of steel, whether by pneumatic, open hearth, or electric furnace techniques, and whether the heat of steel is poured into ingot molds or is continuously cast, the steel is transferred by ladles or tundishes during the steel making operation. The ladle has a shell which is fabricated from steel plate and is lined with a refractory brick to withstand temperatures in excess of 2000° F. In the case of open hearth steel making processes, the tap hole of the furnace is opened and the steel heat is emptied into the steel ladle through a tapping spout. The necessary slag cover which, due to its density, floats on the steel overflows the ladle through a slag spout on the ladle and is either received in a slag pot or is merely permitted to run into the cellar of the charging floor for removal. Some slag remains on the steel as the heat is tapped through a pouring nozzle at the bottom of the ladle. The pouring nozzle is typically controlled by a sliding gate or stopper rod assembly. A sliding gate comprises a refractory slab which is mounted below the pouring nozzle for horizontal reciprocation to cut off flow from the nozzle. A stopper rod assembly comprises a refractory rod extending through the bath to the pouring nozzle. The stopper rod includes a ladle rigging for raising and lowering the stopper rod, and comprises a steel shaft which is insulated by fire clay sleeves encircling the rod. The fire clay sleeves must be replaced after a number of heats to prevent the mounting rod from being in contact with the relatively high temperatures. This operation effectively removes a ladle from production until this operation can be completed.

The ladle may be used to transfer molten steel from the steel making furnace and pour it at a controlled rate into continuous casting equipment or into ingots. Where the ladle is employed to feed molten steel to a continuous casting machine, the ladle pours the steel through its bottom opening into a tundish, which serves as a reservoir for the continuous casting mold.

Whether the ladle is employed to supply molten steel to ingot molds or to a tundish, it is essential to terminate the pour prior to the discharge of molten slag from the ladle. Obviously, the inclusion of slag in ingots or in the continuously cast strand results in defects in the finished product, and the presence of slag is extremely corrosive to the tundish lining.

The precise time at which slag may enter the tap hole in the ladle is not merely a matter of observing the slag level in the ladle, since the molten metal and slag tend to form a vortex above the tap opening, and this vortex tends to draw slag into the molten steel exiting the tap hole even though there may exist a significant amount of steel in the ladle. As a precaution, steel makers tend to terminate the pour well prior to pouring all of the steel from the ladle. For example, it is typical practice when pouring a 400,000-lb. heat to terminate pouring with 10,000 lbs. of steel still in the ladle.

The problem of slag inclusion while pouring from a steel making vessel itself, such as a pneumatic steel making vessel as opposed to a transfer ladle, also exists. Early steel making processes, such as the Bessemer process, involved tilting the vessel to pour off the slag, following by further tilting to pour the steel heat. This operation presented numerous difficulties, since much depended upon the skill of the operator. Moreover, slag and steel tend to build up on the lip of the vessel, further complicating the pouring operation.

An alternative approach to pouring over the lip of the vessel is to utilize a tap hole in the sidewall of the vessel. The tap hole is closed during the course of the heat and is opened at the end of the heat. The tap hole is located below the slag layer so that the steel may be removed by progressively tilting the vessel and allowing the slag to float on the molten steel. A major problem in a side tap operation (or, for that matter, a bottom tap operation) is the vortex formed by the molten liquid, which tends to draw the slag through the tap hole during pouring.

Solutions have been proposed which are intended to maximize the amount of steel drawn from a ladle or steel making vessel while retaining the slag, and to minimize the vortexing problem. One such solution is proposed in U.S. Pat. No. 4,526,349, which discloses the use of a spherical heat-stable material having a density such that it floats substantially at the interface between the slag and the steel and the use of a surrounding ring which is substantially toroidal in shape. Preferably, the discrete spherical piece is positioned within the open center of the toroid so that the spherical refractory may be drawn into and plug the tap hole while the surrounding toroid will minimize vortexing and act as a dam for the slag. While this arrangement may effectively control the vortexing problem, the use of the discrete elements poses a handling problem for the caster in positioning a spherical object within a toroidal object during the melting and tapping operation.

In U.S. Pat. No. 4,494,734, there is disclosed a device for the retention of slag during the tapping operation which comprises a cone-shaped refractory having a specific gravity lower than that of the steel in the converter but higher than that of the slag. The device is added to the melt just prior to the formation of a vortex above the tap hole, and is intended to partially plug the tap hole prior to any tapping of slag. It has been determined, however, that the cone-shape disclosed in that patent will not necessarily float in the desired orientation for plugging purposes, but will, rather, be randomly oriented during the pouring operation, since its center of buoyancy is at or very near its center of gravity.

Further examples of closure plugs for ladles or converters may be found in U.S. Pat. Nos. 4,462,574; 3,124,854; 3,934,755; 2,718,398; and 4,390,170.

SUMMARY OF THE INVENTION

This invention provides a closure plug for ladles and converters which effectively cuts off the flow of the melt from the ladle or converter prior to the egress of slag from the ladle or converter. This function is accomplished by a device which is added to the melt prior to tapping and which has a shape permitting it to float in an upright position, which will minimize vortexing, and which will remain dimensionally stable during the tapping operation. The plug according to this invention comprises a refractory material having a unitary shape corresponding to a pair of truncated cones having their bases in apposition, with one of the bases being smaller in diameter than the other base. The larger truncated cone is intended to float in a slag-covered steel melt in an inverted position, with a major portion of its volume projecting through the slag layer and with its truncated apex projecting into the molten steel. The smaller truncated cone portion projects from the melt and serves to provide a higher center of gravity as compared to a plug which is in the shape of a single truncated cone. More particularly, the upper cone raises the center of gravity above the center of buoyancy to permit a restoring force couple if the plug becomes tilted in the bath. It should be appreciated, therefore, that the upper portion of the plug need not be in the shape of a truncated cone, but may comprise equivalent geometric shapes.

The truncated cone which projects through the slag layer and into the molten steel tends to reduce the effects of vortexing and acts as a dam to prevent slag from being drawn into the steel melt and toward the tap hole during the tapping operation. In order to most effectively utilize the plug, the plug should be added to the melt at the beginning of the tapping operation rather than near the end of the operation, when it may be too late to control the formation and propagation of a vortex.

The plug may be fabricated from any suitable refractory material having the ability to resist dissolution in the metal and slag at a temperature of 3000° F. or higher for three hours (the approximate time for tapping 200 tons of steel). A suitable mixture would be about 95% tabular alumina and refractory material steel shot which forms a plug weighing 185 lbs. and having a volume of 0.6 cubic feet. Five pounds of water is added during the mixing operation and is driven off during the drying procedure. A typical plug would comprise a lower inverted conic section having a 16-inch diameter base, a height of 12 inches, and a truncated apex of 2 inches in diameter. An upper truncated conic section has an 8-inch diameter base, a height of 6 inches, and a 2-inch diameter truncated apex. A wire is embedded in the upper conic section for attachment to a burnable suspending device such as a rope.

DETAILED DESCRIPTION OF THE INVENTION

Figure 1:
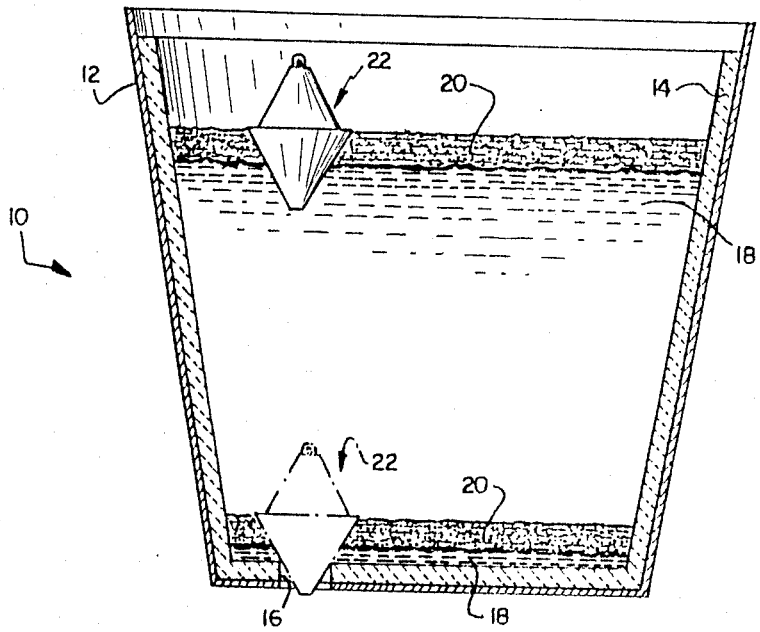
FIG. 1 is a cross-sectional view of a ladle containing a slag-covered steel melt and illustrating a plug according to the present invention.
Figure 2:
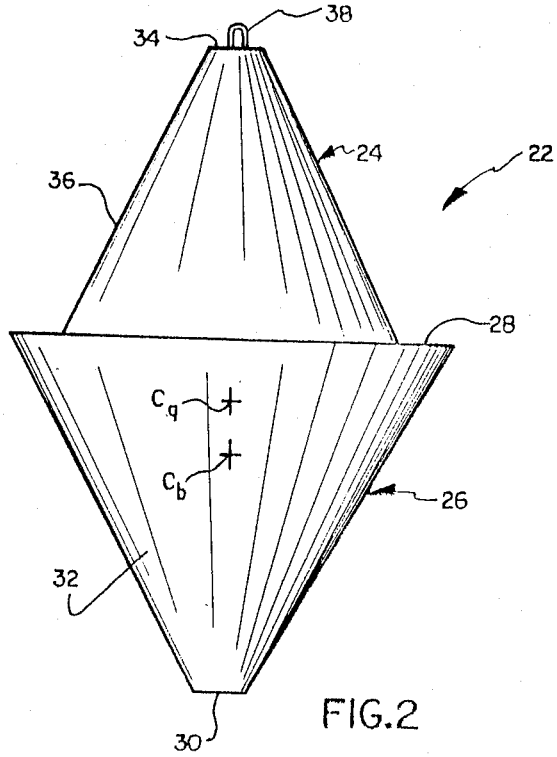
FIG. 2 is an enlarged drawing of the plug according to this invention.

Referring now to the drawings, there is illustrated a conventional steel making ladle or converter 10 having a steel casing 12 and a refractory liner 14 provided with a tap hole 16. The ladle 10 contains a steel melt 18 with a slag covering 20.

During a tapping operation, the liquid steel 18 is drawn from the vessel 10 through the tap hole 16 and just prior to or during the initial stages of tapping, a heat-stable refractory plug 22 is added to the melt. The plug 22 is composed of a suitable refractory material and steel shot in proportions that result in a density of 0.176 lbs. per cubic inch, which is smaller than the density of steel (about 0.25 lbs. per cubic inch) and greater than the density of steel making slags (about 0.10 lbs. per cubic inch). With such a density, the plug according to this invention tends to sink in the slag and tends to displace a predetermined amount of molten steel, due to its shape, for a proper orientation in the vessel 12.

The plug 22 is a unitary body in the shape of a pair of similar truncated cones 24 and 26. The cone 26 has a larger volume than the cone 24, and includes a base 28, a truncated apex 30, and a conical sidewall 32. Similarly, the cone portion 24 includes a truncated apex 34 and a conical sidewall 36.

The plug 22 is molded from a suitable refractory such as calcined or tabular alumina, with steel shot interspersed in the refractory to provide a density of about 0.176 lbs per cubic inch, which is greater than the density of the slag and less than the density of the molten steel. A suitable mixture is 120 lbs. of shot and 80 lbs. of a castable refractory, with sufficient water added to provide a castable slurry. The slurry is molded into the shape of the plug and a wire loop 38 is inserted in the drain casting prior to removal from the mold. After the casting is air-dried, the casting is heated at temperatures which gradually increase up to about 700° F. and then gradually reduced to ambient temperatures to drive out the water. It is important that the plug be thoroughly dried to prevent violent reactions when the plug is added to the melt.

The plug is added to the melt by setting the plug 22 in the melt with a rope which passes through the loop 38. The heat of the melt burns the rope, permitting the plug 22 to float freely in the melt just prior to or during the initial stages of the tapping operation. As may be seen in FIG. 1, the plug 22 floats in a position which extends through the slag layer 20 and into the molten steel 18, with the base 28 of the portion 26 at about the upper level of the slag layer. A yield plug with the portion 24 having a height of 6 inches, a base of 8 inches in diameter, the truncated portion 34 having a diameter of 2 inches, and a portion 26 having a height of 12 inches, a base of 16 inches in diameter, and the truncated portion 30 having a diameter of 2 inches, has a center of gravity $C_g$ located on the longitudinal axis of the plug at a height of 9.388 inches above the truncated portion 30. The center of buoyancy $C_b$ is located 8.06 inches above the truncated portion 30. Therefore, with the center of gravity located above the center of buoyancy, the plug is stable due to the restoring couple when the plug is tipped from its normal position. It has been determined empirically that a plug not having the section 24 has its center of buoyancy substantially corresponding with its center of gravity, and such a conical plug is unstable in the slag layer. It has been found that by adding mass represented by the top cone portion 24, the plug will tend to penetrate into the steel bath, whereas a plug not having the top cone portion will tend to bounce on the steel melt and tumble randomly in the slag layer. It should be appreciated, however, that the particular geometric configuration of the portion 24 is immaterial so long as the portion 24 raises the center of gravity of the entire shape above the center of buoyancy.

As the steel is tapped from the vessel 10, the plug 22 is drawn toward the tap hole 16 by the tendency of the steel to form a vortex. Formation of a deep and well-defined vortex, however, is inhibited by the conical shape of the lower section 26 so that slag from the slag layer 20 tends not to be drawn into the steel near the end of the tapping operation. As may be seen in phantom outline in FIG. 1, the plug 22 completely stops the flow of the melt from the vessel 10 prior to tapping of any slag from the tap hole 16.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A plug for blocking the tap hole of a vessel containing molten steel covered by a layer of slag at the completion of a tapping operation and for reducing vortexing of the steel and slag, comprising a refractory body having an inverted cone-shaped bottom portion and an annular top base surface, said body having an integral refractory top portion projecting axially from said top base surface of the cone-shaped bottom portion, said body having its center of gravity located above its center of buoyancy.

2. A plug according to claim 1, wherein said top portion is cone-shaped with its base integrally formed with the base of said bottom portion.

3. A plug according to claim 2, wherein said top portion has a smaller base than the base of said top portion.

4. A plug according to claim 3, wherein the mass of said top portion is less than the mass of said bottom portion.

5. A plug according to claim 1, wherein the density of said refractory body is greater than the density of said slag and is less than the density of said molten steel.

6. A plug according to claim 5, wherein said body has a center of gravity located above its center of buoyancy when said plug is floating in said layer of slag and projects into said molten steel.

7. A plug according to claim 1, wherein said refractory body is composed of steel shot dispersed in a matrix of alumina.

* * * * *